US006439921B1

(12) United States Patent
Hio

(10) Patent No.: US 6,439,921 B1
(45) Date of Patent: Aug. 27, 2002

(54) TERMINAL FITTING FOR FLAT CONDUCTOR AND METHOD OF CONNECTING TERMINAL FITTING TO FLAT CONDUCTOR

(75) Inventor: Masahide Hio, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/703,912

(22) Filed: Nov. 1, 2000

(30) Foreign Application Priority Data

Nov. 1, 1999 (JP) ..... 11-311361

(51) Int. Cl.[7] ..... H01R 4/24
(52) U.S. Cl. ..... 439/422; 439/397
(58) Field of Search ..... 439/422, 423, 439/424, 425, 399, 401–405, 397, 393

(56) References Cited

U.S. PATENT DOCUMENTS

| | | | | | |
|---|---|---|---|---|---|
| 3,247,316 | A | * | 4/1966 | Weimer, Jr. | 174/94 R |
| 3,960,430 | A | * | 6/1976 | Bunnell et al. | 439/422 |
| 3,997,233 | A | * | 12/1976 | Evans | 439/422 |
| 4,040,702 | A | | 8/1977 | McKee et al. | 439/399 |
| 4,082,402 | A | | 4/1978 | Kinkaid et al. | 439/422 |
| 4,433,890 | A | * | 2/1984 | Marino et al. | 439/425 |
| 4,560,224 | A | * | 12/1985 | Weisenberger | 439/422 |
| 4,784,623 | A | * | 11/1988 | Beck, Jr. | 439/872 |
| 4,832,620 | A | * | 5/1989 | Yamamoto | 439/422 |
| 5,299,954 | A | * | 4/1994 | Ishii | 439/422 |
| 5,389,741 | A | * | 2/1995 | Ueno | 174/117 F |
| 5,447,451 | A | * | 9/1995 | Bishop | 439/422 |
| 6,135,779 | A | * | 10/2000 | Koch et al. | 439/42 |

FOREIGN PATENT DOCUMENTS

| | | |
|---|---|---|
| JP | 63-73861 | 5/1988 |
| JP | 63-73862 | 5/1988 |

* cited by examiner

*Primary Examiner*—Tulsidas Patel
(74) *Attorney, Agent, or Firm*—Anthony J. Casella; Gerald E. Hespos

(57) ABSTRACT

In a terminal of an FFC (10), upper and lower surfaces of a conductive path (11) are covered with an insulation sheet (12). A terminal fitting (20) for the FFC (10) includes a base plate (22) extended from the rear end of a terminal fitting (20). Contact blades (25) are erected on both side edges of the base plate (22). A pressing plate (23) that can be opened and closed confronts the base plate (22). The contact blades (25) pierce through the rear surface of the conductive path (11) of the FFC (10) and project from the upper surface thereof. The pressing plate (23) then is closed in sliding contact with the contact blades (25) at both side edges of the base plate (22) to press the FFC 10 against the base plate (22). Upper end portions of the contact blades (25) then are crimped to the side edge of the pressing plate (23). Because the FFC (10) is pressed against the base plate (22), the conductive path (11) interposed between the contact blades (25) is straight, horizontal and compressed vertically. Consequently, cut surfaces of the conductive path (11) project widthwise and contact the inner surfaces of the contact blades (25) at a high pressure.

12 Claims, 9 Drawing Sheets

TERMINAL FITTING FOR FLAT CONDUCTOR AND METHOD OF CONNECTING TERMINAL FITTING TO FLAT CONDUCTOR

BACKGROUND OF THE INVENTION

1. Field of the Invention

The present invention relates to a terminal fitting that can be connected to a flat conductor and a method of connecting the terminal fitting to the flat conductor.

2. Description of the Related Art

Prior art flat conductors include flexible flat cables (FFC) and flexible print circuit boards (FPC). The prior art FFC includes a plurality of conductive paths arranged in parallel with one another and sandwiched between insulation sheets. The FFC is formed flexibly in the shape of a ribbon. A terminal fitting is connected to each conductive path of the FFC by embedding the conductive paths of the FFC in the insulation sheet or by tearing off a portion of the insulation sheet of the FFC to expose a section of the conductive paths.

The former method is called a through type method, and has an advantage of omitting the stage of tearing off the insulation sheet. This method is disclosed in Japanese Patent Application Laid-Open No. 50-100585, and is shown in FIG. 15A. In this prior art method, contact blades 2 are erected on both side edges of a terminal fitting 1. Both contact blades 2 pierce a conductive path 4 of an FFC 3 to bring cut end surfaces of the conductive path 4 into side surfaces of the contact blade 2.

However, in the above-described method, the FFC is liable to curve between the contact blades 2 when the contact blade 2 pierces through the conductive path 4, as shown in FIG. 15B. Therefore, there is a possibility that insufficient contact pressure is obtained between a cut surface 4A of the conductive path 4 and the side surfaces of the contact blade 2 or that only a part (corner) of an insulation sheet 5 is in contact with the side surfaces of the contact blade 2. Thus, the method does not produce a reliable electrical contact.

SUMMARY OF THE INVENTION

The present invention has been completed in view of the above-described situation. Thus, it is an object of the present invention to obtain a high contact pressure between a contact blade of a metal fitting of through type and a cut surface of a conductive path of a flat conductor.

The subject invention is directed to a terminal fitting for a flat conductor, and specifically a terminal fitting that can be connected to a terminal of a flat conductor in which a conductive path is embedded in an insulation layer. The terminal fitting comprises a base plate disposed on and fixed to a surface of a disposing position of the conductive path. At least one contact blade projects from the base plate and pierces through the conductive path. The terminal fitting further comprises a pressing plate that presses the flat conductor toward the base plate. Thus the flat conductor is sandwiched between the pressing plate and the base plate.

Contact blades preferably are erected on both side edges of the base plate, such that the contact blade at the one side edge confronts the contact blade at the other side edge. In this embodiment, the pressing plate is capable of penetrating into a space between the contact blades that project up from the side edges of the base plate. More particularly, the pressing plate has opposed side surfaces that define a width for the pressing plate. The width is selected such that the side surfaces of the pressing plate slide in contact with inner surfaces of the contact blades that project up from the side edges of the base plate.

The pressing plate preferably is crimped to the flat conductor and remains on the flat conductor, with the flat conductor sandwiched between the base plate and the pressing plate.

A projection may be formed on a surface of the base plate and/or a surface of the pressing plate that confronts the surface of the base plate.

The terminal fitting may further comprise a piercing piece that can be pierced through the conductive path. The piercing piece is formed by bending a front end of the pressing plate in a direction in which the flat conductor is inserted into a space between the base plate and the pressing plate.

The invention also is directed to a method of connecting a terminal fitting to a terminal of a flat conductor in which a conductive path is embedded in an insulation layer. The method comprises projecting a contact blade from a base plate of the terminal fitting. The method continues by piercing the contact blade through the conductive path, with the base plate in contact with a surface of the terminal of the flat conductor. The method then includes pressing the flat conductor against the base plate, with the pressing plate in contact with an opposite surface of the flat conductor.

The contact blade pierces the conductive plate, and the pressing plate presses the flat conductor against the base plate. The conductive path is compressed in a thickness direction. Therefore, cut surfaces of the conductive path project widthwise and contact the contact blades at a high pressure. Consequently, it is possible to obtain a stable electrical performance.

The pressing plate penetrates into the space between the contact blades at both side edges of the base plate, with the pressing plate in sliding contact with the contact blades. Therefore, cut surfaces of the conductive path are adjusted to be straight in the entire width, are compressed vertically and can be brought into contact with the contact blades reliably.

The pressing plate remains on the flat conductor after the terminal fitting is connected to the terminal of the flat conductor. Thus, the pressing plate keeps compressing the conductive path.

The projected portion is pressed against the conductive path. Thus, it is possible to effectively project the cut surfaces of the conductive path widthwise. Further, the projected portion serves as a means for catching the flat conductor, thus firmly holding the flat conductor in resistance to a tensile force applied thereto.

The piercing piece pierces the conductive path, thus hooking the flat conductor and firmly holding the flat conductor in resistance to a tensile force applied thereto and increasing the contact area.

DETAILED DESCRIPTION OF THE PREFERRED EMBODIMENTS

Figure 1:
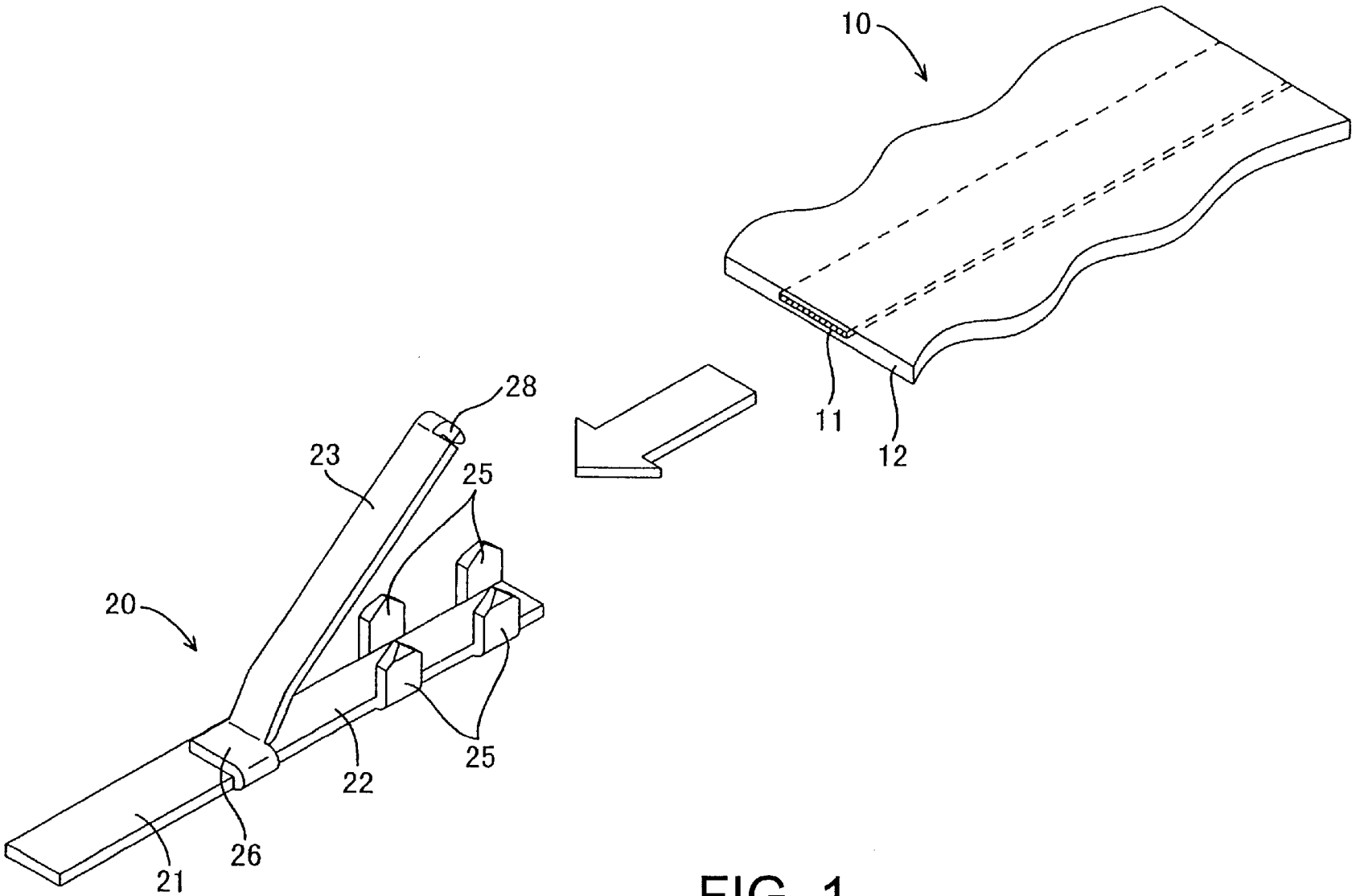
FIG. 1 is a perspective view showing a terminal fitting of a first embodiment of the present invention and an FFC not connected thereto.

A first embodiment of a terminal fitting in accordance with the present invention is identified generally by the numeral 20 in FIGS. 1 through 6. The terminal fitting 20 is intended for use with a flexible flat cable (FFC) 10 that is flexible and ribbon-shaped as a whole. Conductive paths 11 are arranged in parallel with one another at predetermined intervals in the FFC 10. The conductive paths 11 are embedded in insulation sheets 12 disposed on upper and lower surfaces of the conductive paths 11.

Figure 2:
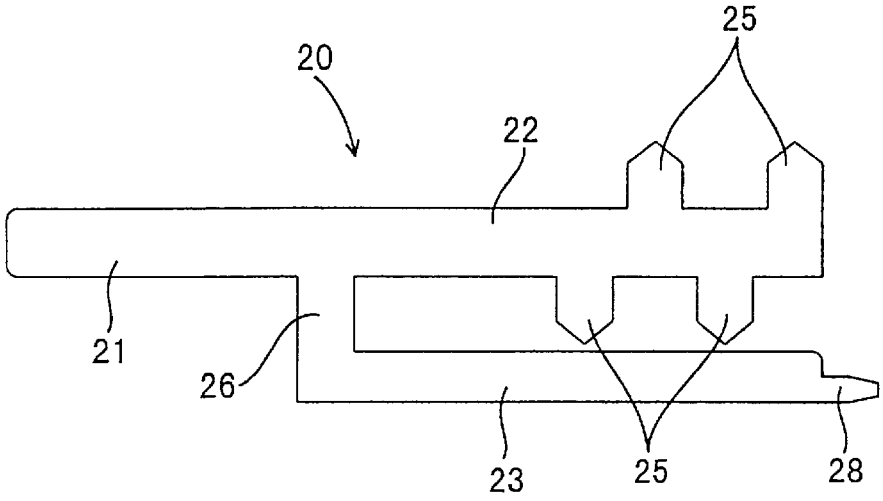
FIG. 2 is a developed view showing the terminal fitting of FIG. 1.

The terminal fitting 20 is a male terminal fitting that is formed by press-molding a highly conductive metal plate. As shown in FIG. 2, the terminal fitting 20 includes opposite front and rear ends. A tab 21 is formed at the front end and is dimensioned to fit on a mating female terminal fitting. A base plate 22 extends rearward from the tab 21, and a pressing plate 23, which will be described in detail later, confronts the base plate 22 vertically.

The base plate 22 is slightly narrower than the conductive path 11 and has two contact blades 25 formed at each of the left and right longitudinal edges thereof. The contact blades 25 are erected on the base plate 22 such that they alternate with one another at different respective longitudinal positions along the base plate 22. The upper end of each contact blade 25 is tapered to a point.

The pressing plate 23 is slightly narrower than the base plate 22 and can penetrate into the space between the opposing contact blades 25, with the pressing plate 23 in sliding contact with the inwardly facing surfaces of the contact blades 25. The terminal fitting 20 initially defines a planar blank, as shown in FIG. 2. The portion of the blank that defines the pressing plate 23 is parallel with the base plate 22, and is joined unitarily to the base plate 22 by a bending part 26 that projects sideways from a portion of the tab 21 substantially adjacent the base plate 22. The blank is formed into the terminal fitting 20 by bending the bending part 26 into close contact with the tab 21. Thus, the pressing plate 23 confronts the base plate 22 and has a front end that is integral with the pressing plate 23. However, the rear end of the pressing plate 23 is not integral with the base plate 22, and can be opened and closed.

A piercing piece 28 that can be inserted into the FFC 10 is formed at the rear end of the pressing plate 23, and extends across about half of the entire width of the rear end of the pressing plate 23. The lower end of the piercing piece 28 is sharp and perpendicularly bent toward the base plate 22.

The procedure of connecting the terminal fitting to the FFC in the first embodiment is described below.

Figure 3:
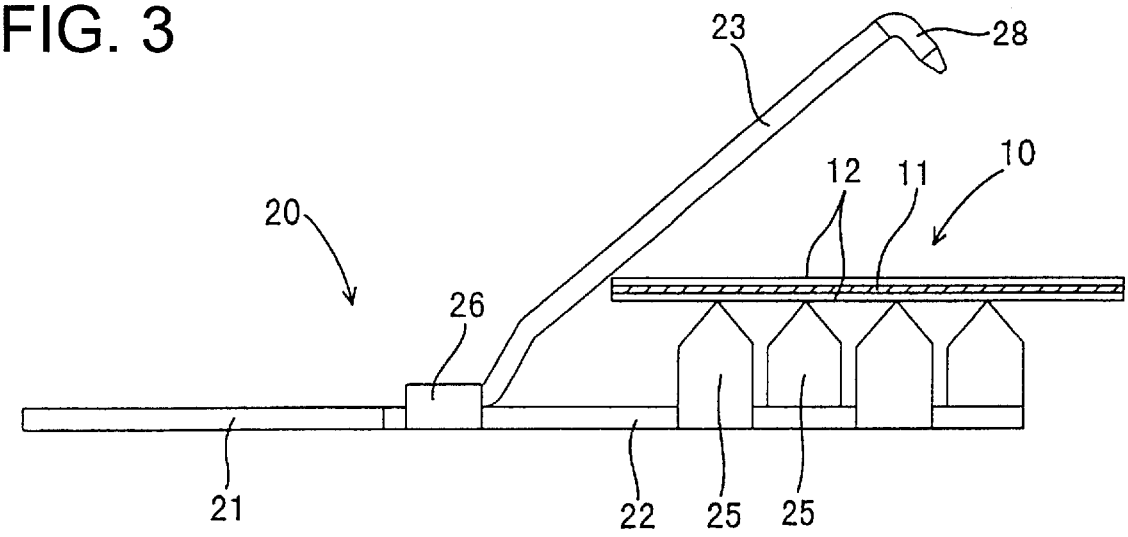
FIG. 3 is a partly cutout side view showing the terminal fitting and the FFC not connected thereto.
Figure 4:
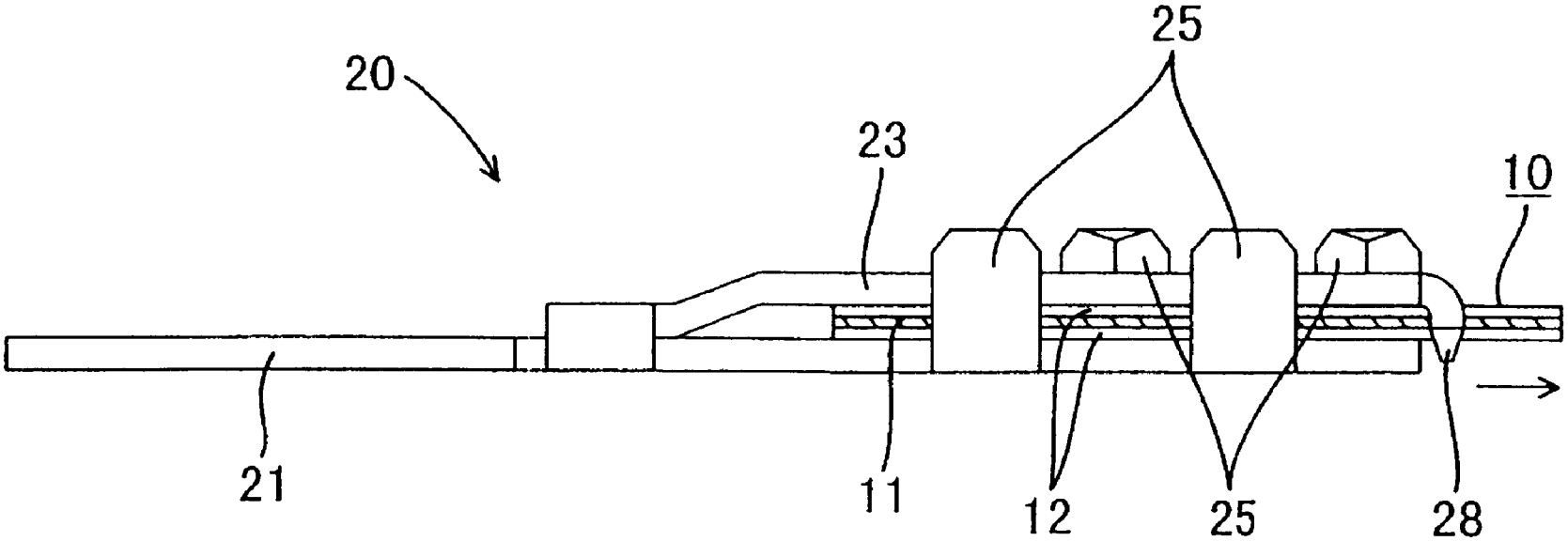
FIG. 4 is a partly cutout side view showing the terminal fitting and the FFC connected thereto.
Figure 5:
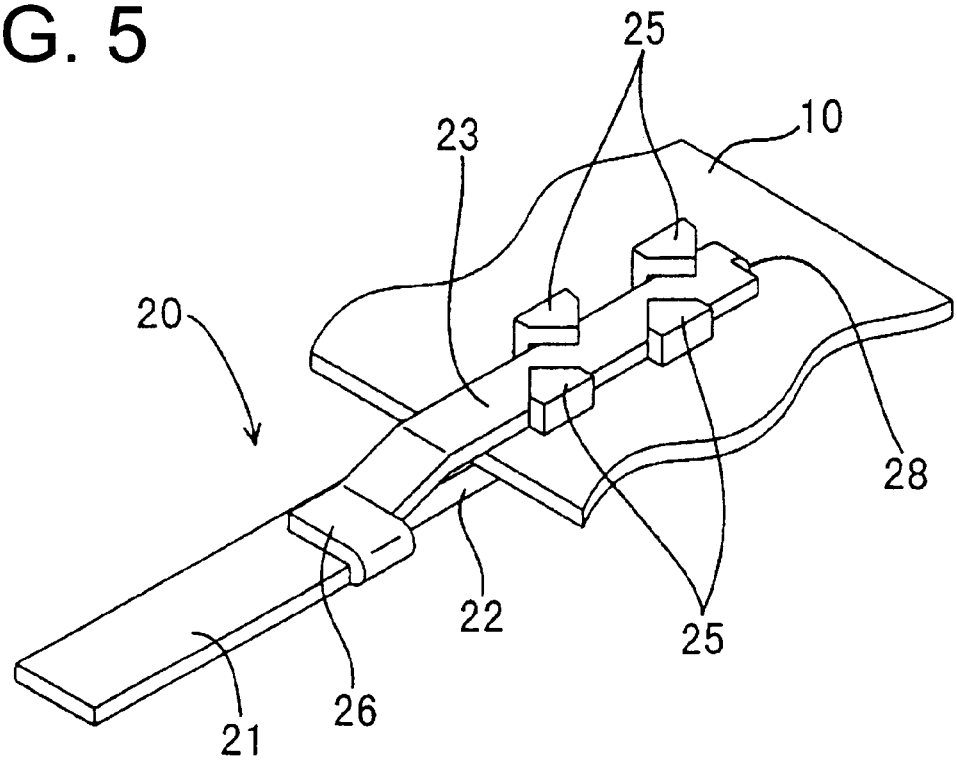
FIG. 5 is a perspective view showing the terminal fitting and the FFC connected thereto.

As shown in FIGS. 1 and 3, the pressing plate 23 of the terminal fitting 20 is opened upward, and an end region of the FFC 10 is inserted between the base plate 22 and the pressing plate 23. This insertion is carried out to align the mating position of the conductive path 11 to the location of the terminal fitting 20. The contact blades 25 at the left and right side edges of the base plate 22 then are pierced through the conductive path 11 at positions located slightly inward from the left and right side edges of the conductive path 11. More particularly, the pressing plate 23 is closed to press the terminal of the FFC 10 against the base plate 22. At this time, the piercing piece 28 formed at the rear end of the pressing plate 23 penetrates through the disposing position of the conductive path 11 of the FFC 10 and projects from the lower surface of the FFC 10. At the final stage, the contact blades 25 are crimped to the left and right side edges of the pressing plate 23 by bending the projected upper end portions of the contact blades 25 inwardly. As a result, as shown in FIGS. 4 and 5, the base plate 22 and the pressing plate 23 are connected to each other in a closed state.

Figure 6:
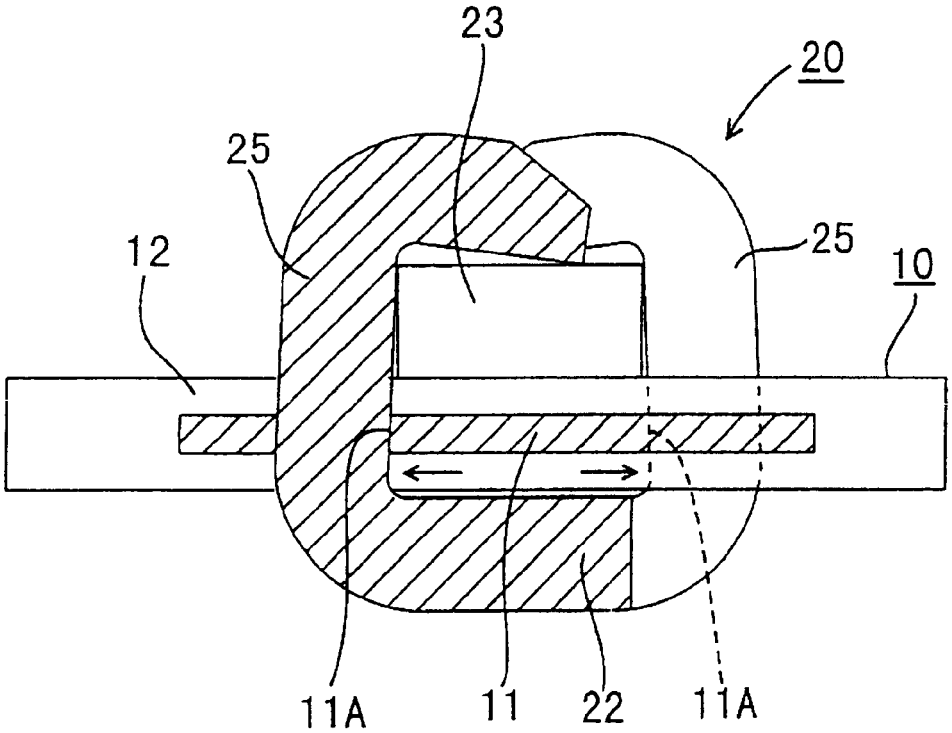
FIG. 6 is an enlarged cross-sectional view of FIG. 5.

In the first embodiment, after the contact blades 25 pierce the conductive path 11, the pressing plate 23 presses the FFC 10 against the base plate 22. The pressing plate 23 penetrates into the space between the left and right contact blades 25, with the pressing plate 23 in sliding contact with the contact blades 25. Therefore, as shown in FIG. 6, the FFC 10 is allowed to be straight and horizontal and is compressed vertically. Consequently, both cut surfaces 11A of the conductive path 11 are interposed between the confronting contact blades 25 and contact the inner surfaces of the contact blades 25 at a high pressure. Thus, it is possible to obtain a stable electrical performance.

The pressing plate 23 keeps pressing the conductive path 11 against the base plate 22, and keeps the conductive path 11 in a compressed state.

The FFC 10 is used by connecting the terminal fitting 20 with the FFC 10 and then accommodating the terminal fitting 20 in a cavity of a connector housing (not shown). A tensile force may be applied rearwardly to the FFC 10, as shown by the arrow in FIG. 4. As explained above, the contact blades 25 pierce the FFC 10, with the contact blades 25 parallel to the direction of the applied tensile force. Thus, there is a fear that the tensile force may cause the terminal fitting 20 to tear the FFC 10 and be removed from the FFC 10, and that the electrical performance of the contact surface is not reliable.

In the first embodiment, however, the piercing piece 28 at the rear end of the pressing plate 23 pierces the FFC 10 in a direction perpendicular to the direction of the applied tensile force, thus hooking the terminal fitting 20 firmly in resistance to the tensile force. Therefore, the terminal fitting 20 is not removed easily from the FFC 10 and thus the contact surface is obtained securely. Further, the piercing piece 28 pierces the conductive path 11, thus contributing to the increase of the contact area between the terminal fitting 20 and the conductive path 11.

Figure 7:
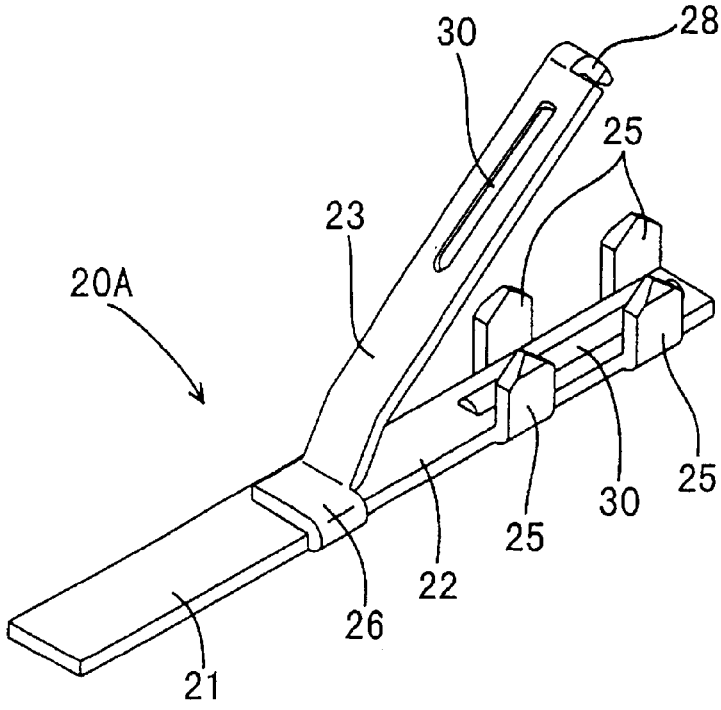
FIG. 7 is a perspective view showing a terminal fitting of a second embodiment of the present invention not connected to the FFC.
Figure 8:
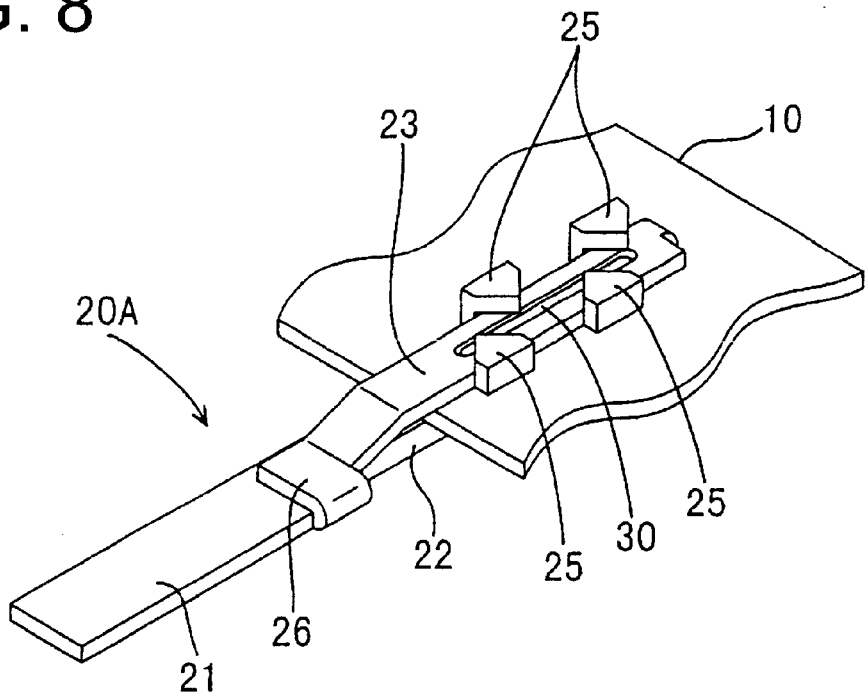
FIG. 8 is a perspective view showing the terminal fitting of FIG. 7 connected to the FFC.
Figure 9:
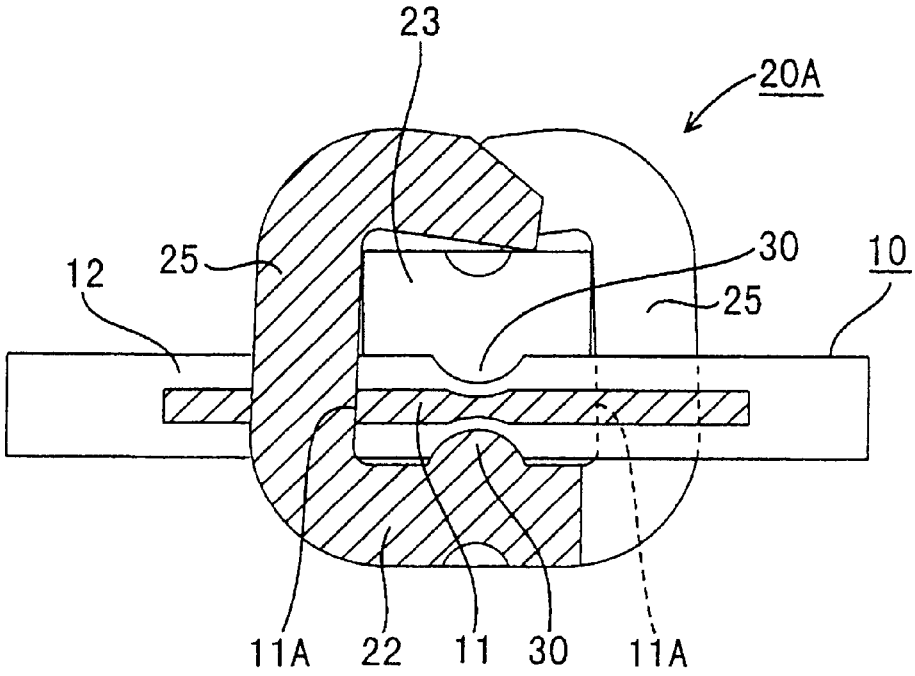
FIG. 9 is an enlarged cross-sectional view of FIG. 8.

FIGS. 7 through 9 show the second embodiment. As shown in FIG. 7, a terminal fitting 20A of the second embodiment has convexities 30 embossed longitudinally along the upper surface of the base plate 22 and the lower surface of the pressing plate 23, such that the convexities 30 confront each other vertically. The length of each convexity 30 is almost equal to the length of the entire longitudinal region in which the contact blades 25 are formed.

The other structural elements of the terminal fitting 20A are similar to those of the first embodiment. Thus parts of the second embodiment that have the same function as parts of the first embodiment are denoted by the same reference numerals and symbols. Therefore, the descriptions of these similar parts are omitted herein.

In the second embodiment, the contact blades 25 pierce through the conductive path 11 at positions located slightly inward from the left and right side edges thereof. Then, the pressing plate 23 presses the FFC 10 against the base plate 22. At this time, the FFC 10 is interposed between the left and right contact blades 25, as shown in FIG. 9. Thus the FFC 10 is allowed to be straight and horizontal, and is compressed effectively vertically between the upper and lower convexities 30. Accordingly, both cut surfaces 11A of the conductive path 11 can be brought into contact with the inner surfaces of the contact blades 25 at a higher pressure.

Figure 10:
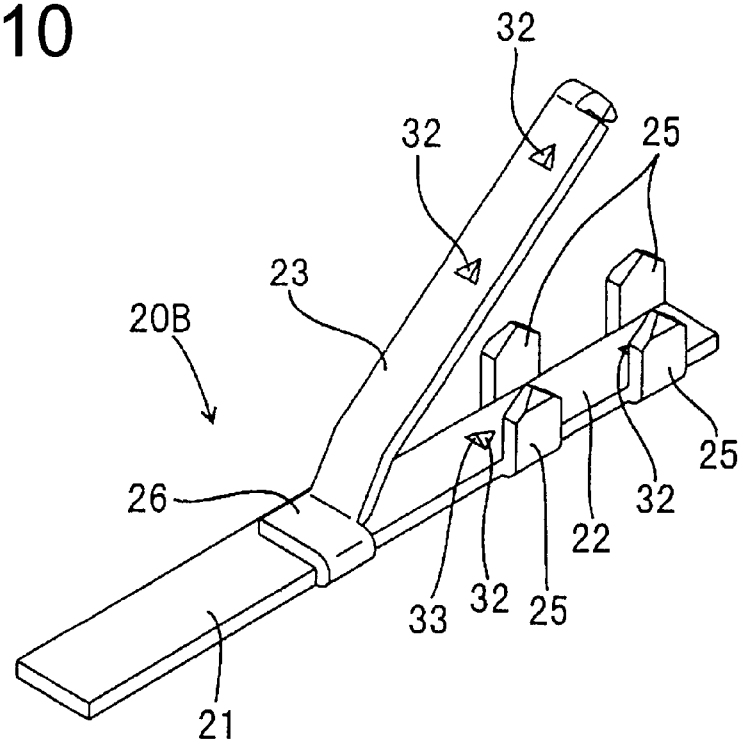
FIG. 10 is a perspective view showing a terminal fitting of a third embodiment of the present invention not connected to the FFC.
Figure 11:
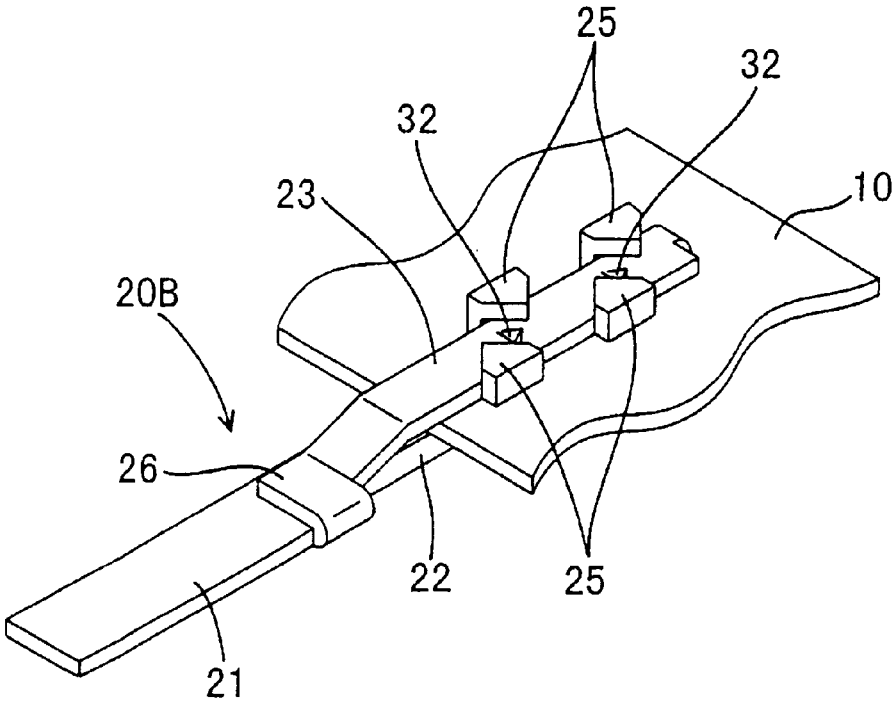
FIG. 11 is a perspective view showing the terminal fitting of FIG. 10 connected to the FFC.
Figure 12:
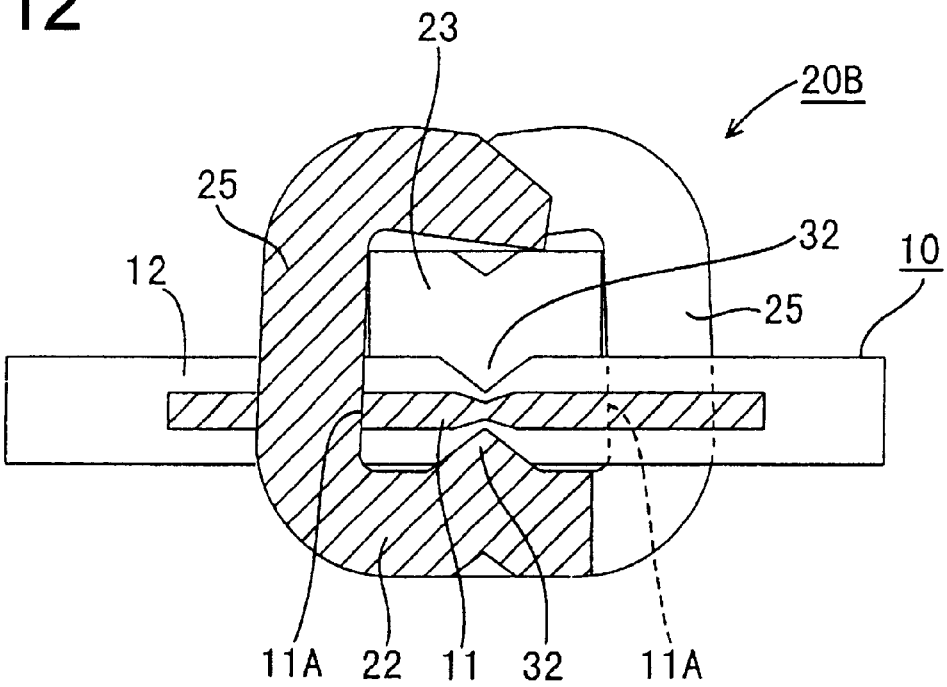
FIG. 12 is an enlarged cross-sectional view of FIG. 11.

FIGS. 10 through 12 show the third embodiment of the present invention. As shown in FIG. 10, a terminal fitting 20B of the third embodiment has two projections 32 embossed longitudinally along the upper surface of the base plate 22 and two projections 32 embossed longitudinally along the lower surface of the pressing plate 23. Each projection 32 is wedge-shaped and has triangular cut lines 33 formed on the lower surface of the base plate 22 and the upper surface of the pressing plate 23. The projections 32 confront each other vertically in the vicinity of the contact blades 25.

The other constructions are similar to those of the first embodiment. Thus the parts of the third embodiment that have the same functions as those of the first embodiment are denoted by the same reference numerals and symbols. Therefore, the descriptions of those similar parts are omitted herein.

In the third embodiment, the contact blades 25 pierce through the conductive path 11 at positions located slightly inward from the left and right side edges of the conductive path 11. Then, the pressing plate 23 presses the terminal of the FFC 10 against the base plate 22. At this time, the FFC 10 is interposed between the left and right contact blades 25, as shown in FIG. 12. Thus, the FFC 10 is allowed to be straight and horizontal, and is compressed effectively vertically between the confronting projections 32. Accordingly, both cut surfaces 11A of the conductive path 11 can be brought into contact with the inner surfaces of the contact blades 25 at a higher pressure.

Further, the projections 32 cut into the FFC 10, thus being effective for holding the FFC 10 in resistance to a tensile force applied thereto.

The present invention is not limited to the embodiments described above with reference to the drawings. For example, the following embodiments are included in the technical scope of the present invention. Further, various modifications can be made without departing from the spirit and scope of the present invention.

Figure 13:
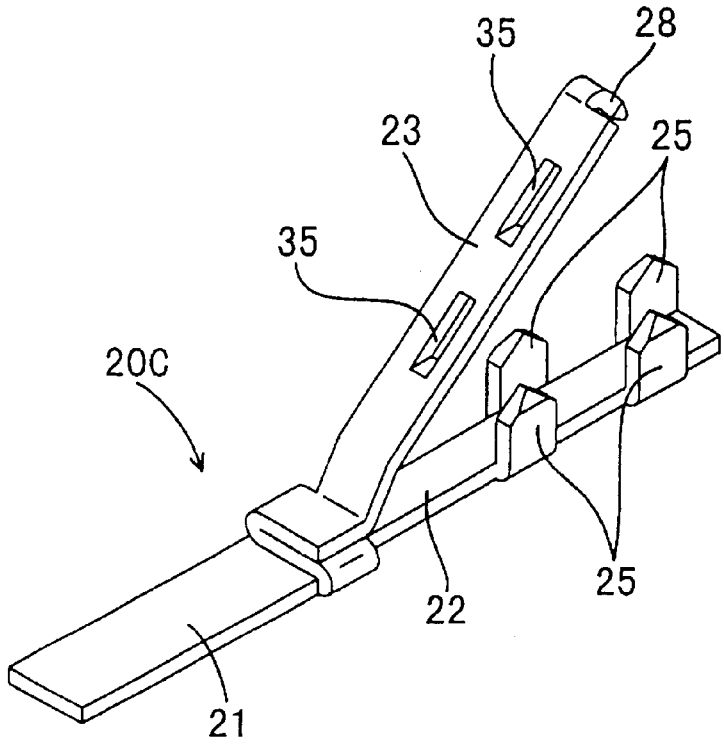
FIG. 13 is a perspective view showing a terminal fitting of another embodiment of the present invention not connected to the FFC.
Figure 14:
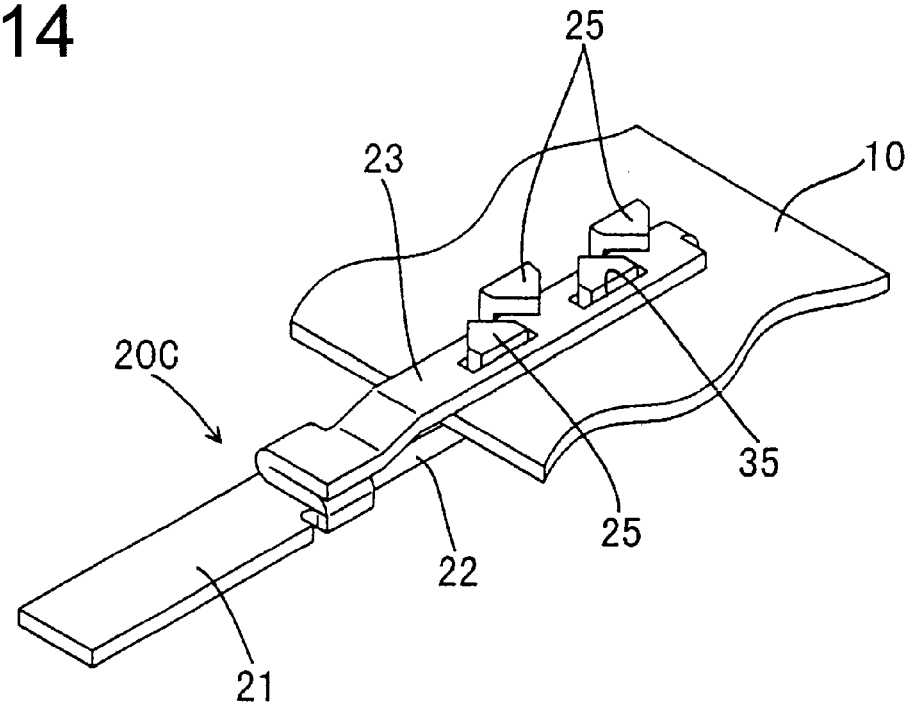
FIG. 14 is a perspective view showing the terminal fitting of FIG. 13 connected to the FFC.
Figure 15A:
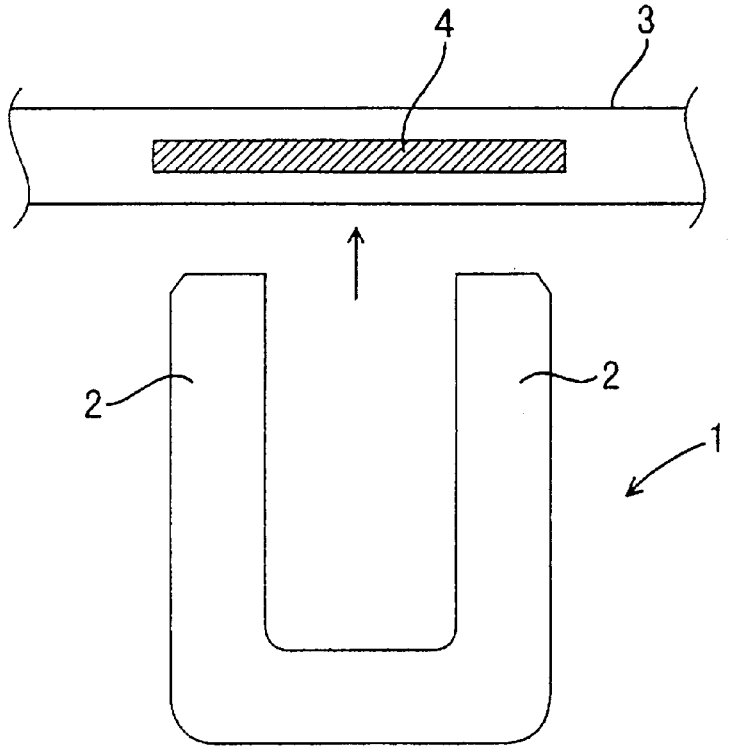
FIG. 15A PRIOR ART
FIG. 15 is a sectional view showing a conventional connection mode.
Figure 15B:
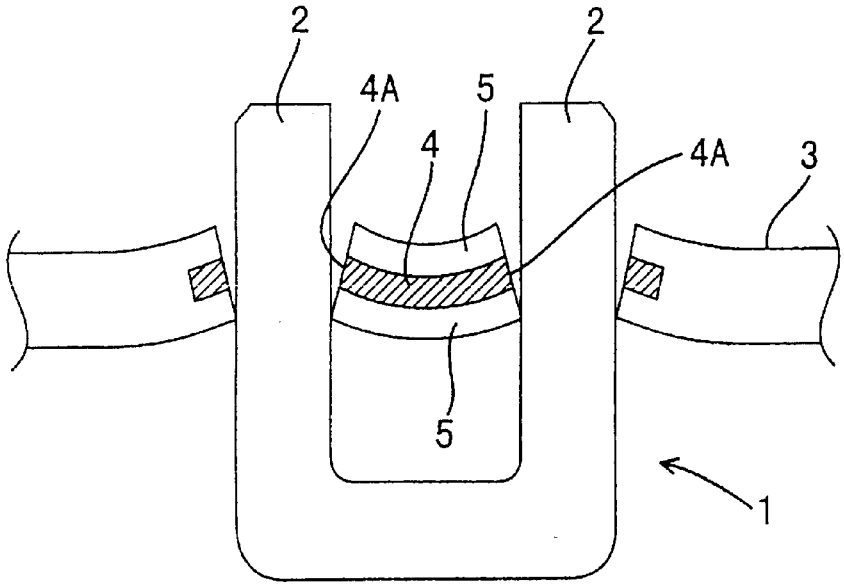
FIG. 15B PRIOR ART

As shown in FIGS. 13 and 14, it is possible to form a contact blade insertion hole 35 through the pressing plate 23 of a terminal fitting 20C to caulk the contact blade 25 at one side edge of the base plate 22 to the insertion hole 35. The contact blade 25 may be formed on only one side edge of the base plate 22.

It is also possible to penetrate the contact blade at one side edge of the base plate into the conductive path and crimp the contact blade at the other side thereof to the pressing plate.

The pressing plate may be separate from the base plate and may be removed from the FFC after the pressing plate is used to press the FFC against the base plate.

It is possible to connect the terminal fitting to the FFC by turning the base plate and the pressing plate upside down.

The present invention can be used to connect the female terminal fitting to the FFC.

It is possible to apply the present invention to not only the FFC exemplified in the first embodiment, but also terminal fittings to be used in connection with the flat conductor such as an FPC in which the conductive path is covered with the insulation layer.

What is claimed is:

1. A terminal fitting for a flat conductor, the flat conductor having a conductive path of a specified width, said conductive path being embedded in an insulation layer, the insulation layer having opposite outer surfaces defining a specified thickness for the flat conductor, the terminal fitting being unitarily formed from a conductive material and comprising:

a base plate having opposite first and second side edges spaced from one another by a distance less than the specified width;

a plurality of contact blades, each said contact blade extending unitarily from one of said side edges of the base plate and projecting from the base plate a distance greater than the specified thickness; and a pressing plate having opposite side edges, a front end fixed in proximity to said base plate and a rear end pivotable toward and away from said base plate, said pressing plate being configured to pivot beyond the ends of the contact blades most distant from said base plate, the pressing plate further having at least one projection projecting toward the base plate a distance less than the specified thickness from a location between the side edges of the pressing plate.

2. The terminal fitting of claim 1, wherein said contact blades comprise four contact blades, said four contact blades comprising two spaced apart contact blades projecting from a first of said edges of said base plate and two contact blades projecting from a second of said side edges of the base plate.

3. The terminal fitting of claim 1, wherein the contact blades on the first side edge of said base plate are offset longitudinally from the contact blades on the second side edge of the base plate.

4. The terminal fitting of claim 1, further comprising a piercing piece projecting from the pressing plate, the piercing piece having a pointed end spaced from the pressing plate.

5. The terminal fitting of claim 4, wherein the pressing plate is pivotable about an axis, said piercing piece being substantially planar and aligned substantially parallel to the pivot axis of the pressing plate.

6. The terminal fitting of claim 1, wherein the pressing plate is dimensioned to fit between the contact blades on the first side edges of the base plate and the contact blades on the second side edge of the base plate.

7. The terminal fitting of claim 1, wherein the base plate includes at least one projection projecting toward the pressing plate.

8. The terminal fitting of claim 1, wherein the projection comprises a cut aligned transversely relative to said front and rear ends of said pressing plate and an embossment between the cut and the rear end of the pressing plate such that said projection is substantially wedge-shaped.

9. The terminal fitting of claim 8, wherein the insulation layer defines a selected thickness, the projection projecting from the pressing plate a distance less than the thickness of the insulation layer.

10. The terminal fitting of claim 9, wherein the at least one projection comprises a plurality of projections spaced from one another along a longitudinal direction extending between the front and rear ends of the pressing plate.

11. The terminal fitting of claim 10, wherein the base plate includes at least one projection substantially identical to the projections on the pressing plate and projecting toward the pressing plate.

12. The terminal fitting of claim 11, wherein the base plate and the pressing plate have an equal number of projections, the projections on the base plate being substantially aligned with the projections on the pressing plate.

* * * * *